United States Patent [19]

Saegusa

[11] Patent Number: 4,735,075

[45] Date of Patent: Apr. 5, 1988

[54] BENDING DEVICE FOR AUTOMATIC PIPE BENDER

[75] Inventor: Shigeru Saegusa, Sunto, Japan

[73] Assignee: USUI Kokusai Sangyo Kabushiki Kaisha, Sunto, Japan

[21] Appl. No.: 916,175

[22] Filed: Oct. 7, 1986

[30] Foreign Application Priority Data

Oct. 21, 1985 [JP] Japan ..... 60-234785

[51] Int. Cl.[4] ..... B21D 7/024

[52] U.S. Cl. ..... 72/306; 72/217; 72/384; 72/388

[58] Field of Search ..... 72/306, 307, 319, 321, 72/216–219, 388, 387, 149, 293, 305, 384

[56] References Cited

U.S. PATENT DOCUMENTS 3,245,433 4/1966 Taylor, Jr. ..... 72/134
3,373,587 3/1968 Shubin et al. ..... 72/307
3,493,016 2/1970 Ott ..... 72/307
4,000,636 1/1977 Shubin et al. ..... 72/307
4,604,885 8/1986 Lang ..... 72/306

FOREIGN PATENT DOCUMENTS 1435033 5/1976 United Kingdom ..... 72/306

*Primary Examiner*—Daniel C. Crane
*Attorney, Agent, or Firm*—Anthony J. Casella; Gerald E. Hespos

[57] ABSTRACT

A bending device for use in an automatic pipe bender comprises a chuck unit for gripping a straight pipe, a bending unit, and a movable unit. The movable unit can move forward and backward longitudinally of the pipe placed in position. A rotary member is mounted to the movable unit so as to be rotatable within a range of 360° in a direction perpendicular to the axis of the pipe. The bending unit is mounted to the rotary member so that the bending unit rotates with the rotary member.

3 Claims, 2 Drawing Sheets

BENDING DEVICE FOR AUTOMATIC PIPE BENDER

BACKGROUND OF THE INVENTION

1. Field of the Invention

The present invention relates to a bending device for use in an automatic bender for relatively thin metal tubes having diameters less than about 20 mm, which tubes are frequently used in motor vehicles, various machinery, and other equipment such as oil or air supply conduits.

2. Description of the Prior Arts

A conventional bending device of this kind has a torsion unit that holds a pipe in an appropriate position. The pipe is rotated about its axis by the torsion unit to select the direction in which the pipe is to be bent. One or two bending units are provided on one or both sides of the torsion unit to bend the pipe in the selected direction.

In this conventional bending device, the pipe is rotated about its axis by the torsion unit. Therefore, when the pipe is bent in a stepwise fashion from its front end, the portion already bent on the side of the front end is twisted back and forth. Accordingly, if the pipe has a thin wall and is long, then the region at which the pipe is bent is severely deformed. For this reason, this bending device tends to be used to process only those pipes which are relatively large in diameter, have thick walls, and are short. For this reason, the conventional bending device has found only limited use.

SUMMARY OF THE INVENTION

It is an object of the present invention to provide a bending device which is at least substantially free of the foregoing problems.

According to one aspect of the invention we provide a bending device comprising a chuck unit for gripping and holding a pipe, a moveable unit capable of moving forward or backward along the axis of the pipe held by the chuck unit, and a bending unit mounted on a rotable member ounted on the movable unit so that the bending unit can be relative to the pipe rotated by the rotary member.

According to another aspect of the invention we provide a bending device for use in an automatic pipe bender and having a chuck unit for gripping a straight pipe at appropriate positions and at least one bending unit disposed at least on one side of the chuck unit, the bending unit being capable of moving forward and backward, said bending device comprising:

a movable unit capable of moving in either direction along a pipe which has been fixed in position, the movable unit having a support member provided with a first guide groove on its upper end, to guide the pipe when the pipe has been brought into position, the support member holding a rotary member which has a second guide groove similar in shape to the first guide groove, the second guide groove extending to the vicinity of the axis of the pipe and being capable of registering with the first guide groove; and a bending unit mounted on the rotary member that can rotate through up to 360° in a plane perpendicular to the axis of the pipe, the bending unit rotating with the rotary member to establish the direction in which the pipe is to be bent.

Further objects, advantages and features of the present invention will become more fully apparent from a detailed consideration of the arrangement and construction of the constituent parts as set forth in the following specification taken together with the accompanying drawings.

DETAILED DESCRIPTION OF THE INVENTION

Figure 1:
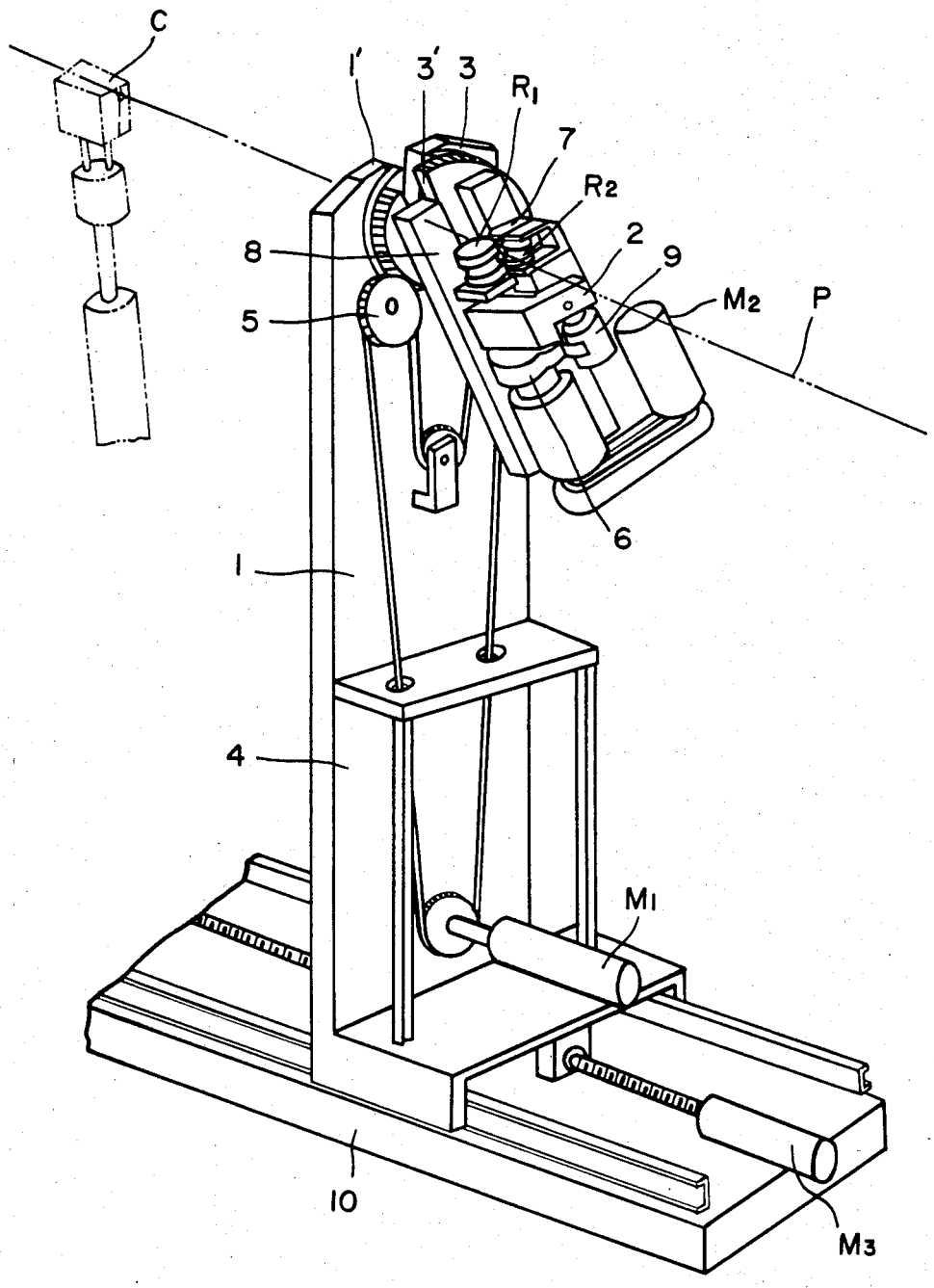
FIG. 1 is a perspective view of a bending device for use in an automatic pipe bender, the device being fabricated in accordance with the invention.
Figure 2A:
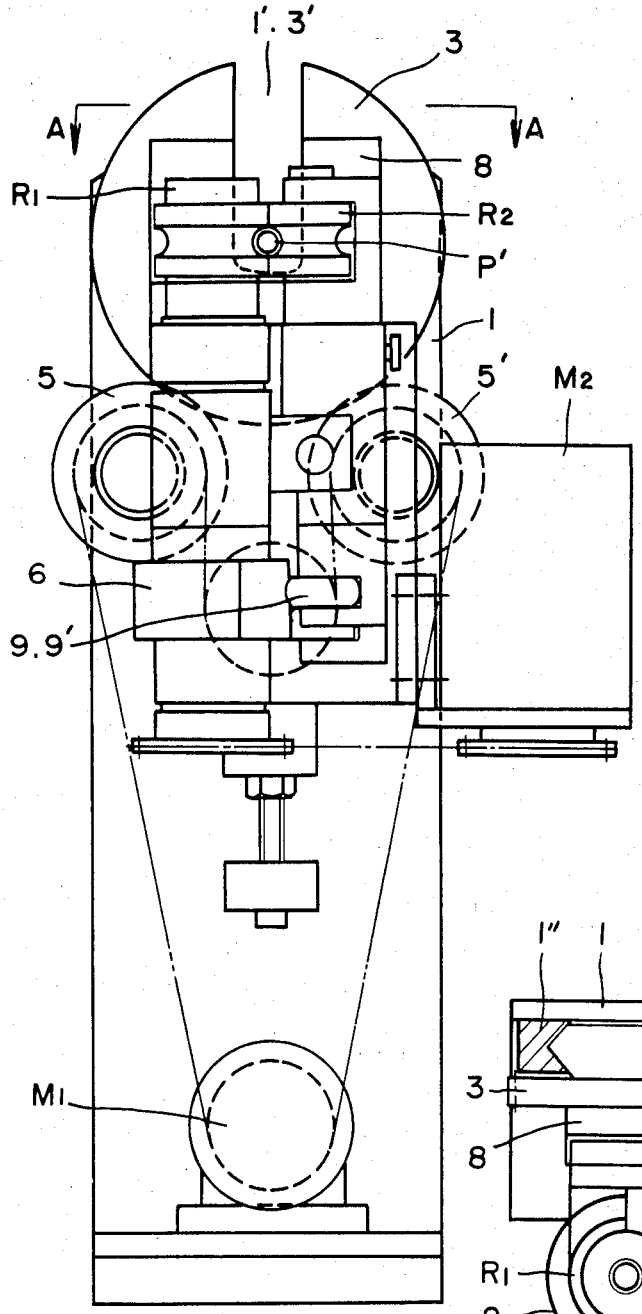
FIG. 2*a* is a front elevation of the bending device shown in FIG. 1.
Figure 2B:
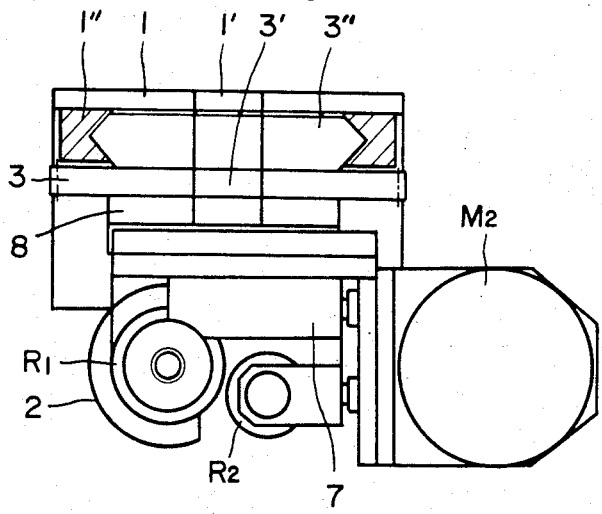
FIG. 2*b* is a cross-sectional view taken on line A—A of FIG. 2*a*.

The bending device consists of a movable unit 4 and a bending unit 2. The movable unit 4 comprises a rotary member 3 including a driven toothed wheel and a support member 1 with a base mounted on a frame 10 such that it can be moved by an external servomotor $M_3$ forward or backward along a pipe P to be bent. The support member 1 is provided with a guide groove 1' on its upper end. This groove 1' acts to guide the pipe P when the pipe is brought into position. The support member 1 also has an annualr guide member 1''. The rotary member 3 has a guide groove 3' similar in shape to the guide groove 1'. The groove 3' extends to the vicinity of the axis of the pipe, and is capable of registering with the guide groove 1'. An annular boss 3'' protrudes from the rotary member 3 around the axis of the aforementioned driven wheel, and is pivotally mounted to the inner surface of the guide member 1''. The rotary member 3 is so held that it can rotate through up to 360° in a direction perpendicular to the axis of the pipe P.

Two driving toothed wheels 5 and 5' are mounted on the support member 1 and spaced a given distance from each other. The bending unit 2 is mounted on the rotary member 3 that is rotated by the aforementioned driven wheel which is in mesh with the driving wheels 5 and 5'. As the rotary member 3 is turned, the bending unit 2 is rotated in a direction perpendicular to the axis of the pipe. The bending unit 2 comprises a base plate 8, a die roller $R_1$ mounted on the plate 8, a pressure roller $R_2$ disposed opposite to the roller $R_1$, and a clamping cap 7 disposed adjacent to the pressure roller $R_2$. The pressure roller $R_2$ is rotated around the die roller $R_1$ via a cam 6 by a servomotor $M_2$. The cam b is mounted to the member that holds the die roller $R_1$. Cam contact member 9 and 9' are pressed against the cam 6 by springs (not shown). The members 9 and 9' are mounted on the member that holds the clamping cap 7, and face the cam 6. The cam 6 is driven by the servomotor $M_2$ to clamp or bend the pipe, or is returned to its original position. A chuck unit C grips a straight pipe P at an appropriate point to fix it in position. The pipe is guided along the guide grooves 1' and 3' and positioned within the space defined by the die roller $R_1$, the pressure roller $R_2$, and the clamping cap 7.

In the operation of the bending device constructed as described above, the cam contact members 9 and 9' are pressed against the cam surface by the springs (not shown), keeping the pressure roller $R_2$ away from the die roller $R_1$ and the clamping cap 7. Under this condition, the pipe P which is straight is fed manually or by a conveyance shooter (not shown). Then, the pipe is gripped and held by the chuck unit C. In this state, the pipe is caused to pass through the guide grooves, and is then fixed in position. The external servomotor $M_3$ is operated so that the movable unit 4 moves into or out of a desired position on the frame 10 at which the pipe is to be bent. Then, the servomotor $M_1$ is driven to rotate the rotary member 3 consisting of the driven toothed wheel in mesh with the driving wheels 5 and 5', for bringing the bending unit 2 to a desired position. When this desired position is reached, the servomotor $M_2$ is driven to bring the cam contact members 9 and 9' into contact with the cam, so that the clamping cap 7 and the pressure roller $R_2$ bear against the die roller $R_1$. The pressure roller $R_2$ is rotated around the die roller $R_1$ to bend the pipe through a desired angle. After this bending operation is finished, operation of the motor $M_2$ in the opposite direction and the biasing force of the springs (not shown) restore the pressure roller $R_2$ to its original position. At the same time, the clamping cap 7 and the pressure roller $R_2$ are moved away from the die roller $R_1$. In this way, the pipe P is bent as desired in a stepwise manner from its front end.

It is also possible automatically to control (1) the position of the movable unit 4 on the frame 10 at which a bending operation is performed, (2) the direction in which the bending unit 2 is rotated by the rotary member 3, and (3) the angle through which the pipe is bent by the pressure roll $R_2$, by previously storing bending data in a control apparatus (not shown). This data is obtained by predetermining the increments in which the movable unit should move forward or backward and the sequence in which they are to be performed.

As described above, the novel bending device for use in an automatic pipe bender has a chuck unit C for gripping and holding the pipe. The movable unit 4 is moved forward or backward on at least one side of the pipe P which has been placed in position. The rotary member 3 is rotated on the support member 1 of the movable unit 4 when the unit 4 has been placed in position. The bending unit 2 is mounted on this rotary member 3. Therefore, when the pipe P is bent in a stepwise manner from its front end, the portion of the pipe that has been already bent is not deformed. Accordingly, even if the pipe is small in diameter, has a thin wall, and is long, the device can be used without presenting any problems. Since the bending unit 4 can rotate through 360°, the device can process the pipe over a greatly extended range. Hence, various shapes can be obtained by bending. Furthermore, the pipe can be bent to close tolerances.

While the present invention has been described with reference to particular embodiments thereof, it will be understood that numerous modifications may be made by those skilled in the art without actually departing from the spirit and scope of the invention as defined in the appended claims.

What is claimed is:

1. a bending device for use in an automatic pipe bender and having a chuck unit for gripping a straight pipe at appropriate positions and at least one bending unit disposed at least on one side of the chuck unit, the bending unit being movable toward and away from said chuck, said chuck being oriented relative to said bending unit so that a pipe held by said chuck extends along its axis into the bending unit, said bending device comprising:

a movable unit having means to move said unit in either axial direction along a pipe which has been fixed in position by said chuck, the movable unit having a support member provided with a first guide groove on its upper end, to guide the pipe when the pipe has been brought into position, the support member holding a rotary member which has a second guide groove similar in shape to the first guide groove, the second guide groove extending to the vicinity of the axis of the pipe and being capable of registering with the first guide groove, the movable unit further comprising means for rotating the rotary member 360° relative to said support member, such that upon rotation of said rotary member, said grooves are out of register; and a bending unit mounted on the rotary member that can rotate with the rotary member 360° in a plane perpendicular to the axis of the pipe, whereby the bending unit is rotatable with the rotary member to establish the direction in which the pipe is to be bent, said bending unit having means to bend said pipe transverse to its axis.

2. The bending device of claim 1, wherein the means for rotating said rotary member comprises a toothed wheel driven by an electric motor.

3. The bending device of claim 2, wherein said toothed wheel is driven by the motor via two gears in mesh with the toothed wheel.

* * * * *